US005205133A

United States Patent [19]

Lackstrom

[11] Patent Number: 5,205,133

[45] Date of Patent: Apr. 27, 1993

[54] HIGH EFFICIENCY POOL HEATING SYSTEM

[75] Inventor: David Lackstrom, Medina, Ohio

[73] Assignee: R & D Technologies, Inc., Willington, Conn.

[21] Appl. No.: 821,391

[22] Filed: Jan. 16, 1992

[51] Int. Cl.[5] ..... F25B 27/00; F25B 1/00; F25B 1/02

[52] U.S. Cl. ..... 62/238.4; 62/467; 62/238.6; 62/501; 60/671; 92/98 D; 417/401; 165/29; 237/12.1

[58] Field of Search ..... 62/467, 238.4, 238.6, 62/501; 60/671; 237/12.1, 13; 165/29; 417/403, 401, 399, 379; 92/98 D

[56] References Cited

U.S. PATENT DOCUMENTS

| | | | |
|---|---|---|---|
| 3,043,338 | 7/1962 | Hanson | 92/98 D |
| 3,153,442 | 10/1964 | Silvern | 165/50 |
| 3,286,766 | 11/1966 | Osborne | 62/467 |
| 3,699,779 | 10/1972 | Schlichtig | 62/501 |
| 3,840,175 | 10/1974 | Jacuzzi | 165/38 |
| 3,861,166 | 1/1975 | Goldsberry | 62/467 |
| 3,988,901 | 11/1976 | Shelton et al. | 62/501 |
| 4,086,956 | 5/1978 | Black et al. | 165/38 |
| 4,143,707 | 3/1979 | Lewis et al. | 165/29 |
| 4,271,679 | 6/1981 | Schäfer | 62/238.4 |
| 4,314,447 | 2/1982 | Gray | 417/401 |
| 4,502,848 | 3/1985 | Robertson et al. | 417/399 |
| 4,666,376 | 5/1987 | Solomon | 417/379 |
| 4,779,427 | 10/1988 | Rowley et al. | 62/467 |
| 5,090,299 | 2/1992 | Santi et al. | 92/98 D |
| 5,129,236 | 7/1992 | Solomon | 62/238.4 |

FOREIGN PATENT DOCUMENTS

| | | | |
|---|---|---|---|
| 1090677 | 4/1955 | France | 417/403 |
| 2360771 | 3/1978 | France | 417/379 |
| 2073862 | 10/1981 | United Kingdom | 60/671 |

OTHER PUBLICATIONS

Bellofram Class 4-C Dynamic Linear Seals Bellofram Corporation, Burlington, Mass. 1976.

*Primary Examiner*—John K. Ford
*Attorney, Agent, or Firm*—Ralph E. Jocke

[57] ABSTRACT

A high efficiency pool heating system (10) includes a power circuit (12) and heat pump circuit (14). Each circuit having a working fluid flowing therein. In the power circuit, a heater (16) vaporizes the working fluid which is periodically delivered and exhausted through a valve section (32) to a driving section (28) of a power unit (26). The driving section drives a driven section (30) which operates as a compressor for the working fluid in the heat pump circuit. Fluid exhausted from the driven section of the power unit is passed to a first portion (48) of a heat exchanger (46) which is in fluid communication with the water of a pool. In the heat exchanger, the working fluid in the power circuit is condensed to a liquid. Thereafter, the liquid is passed through the power circuit back to the heater where it is again vaporized. In the heat pump circit vaporized working fluid is compressed in the driven end of the power unit and delivered to a second portion (50) of the heat exchanger wherein the working fluid delivers heat to the pool water and is condensed. Thereafter, the liquid in the heat pump circuit is passed through a flow expander (98) and into an evaporator (102) wherein the working fluid absorbs heat from atmosphere and vaporizes. The fluid is then delivered to the driven end of the power unit to complete the heat pump circuit.

22 Claims, 12 Drawing Sheets

HIGH EFFICIENCY POOL HEATING SYSTEM

TECHNICAL FIELD

This invention relates to devices for heating water. Particularly this invention relates to a high efficiency pool and spa heating system that is powered by natural gas.

BACKGROUND ART

Heaters for heating water in swimming pools are well known in the prior art. The majority of pool heaters presently in use are gas fired. In such devices, the hot products of combustion are passed through a heat exchanger. Water from the pool is also passed through the heat exchanger and absorbs heat from the products of combustion. While such gas fired units are reliable, they are inefficient. The best theoretical coefficient of performance for such a system is 1:1. Of course the coefficient of performance will always be somewhat less due to losses. This makes a conventional gas fired pool heater expensive to operate.

Other types of pool heaters known in the prior art are electrically powered heat pumps. Such systems use a working fluid such as Freon 22 or other refrigerant, to absorb heat from the atmosphere in an evaporator, resulting in vaporization of the working fluid. The working fluid is then compressed in a compressor and passed to a heat exchanger or condenser that is in heat transfer relation with the pool water. In the heat exchanger the working fluid delivers heat to the pool water and is condensed to a liquid. Thereafter the liquid working fluid flows through an expansion device and returns to the evaporator to complete the cycle. The working fluid continuously flows in the heat pump system to deliver heat from the atmosphere to the pool water.

Because a heat pump system uses heat available from the atmosphere to heat the pool water, such systems may have coefficients of performance in the range of 4:1. However electric heat pump systems may be more expensive to operate than gas fired systems because electricity generally costs more than natural gas. Electric heat pump systems also have a disadvantage in that when the ambient temperature is low, the efficiency of the heat pump system falls. As a result, it is usually necessary to have a supplemental heating system such as a gas fired heater or an electrical resistance heater. Electric heat pump systems also characteristically require more maintenance than gas fired systems which adds to their overall cost.

The need to have a supplemental heating system with a heat pump system increases when the pool is heated in combination with a "hot tub" or spa. People enjoy using their spas year round. In colder climates during the winter a heat pump system alone will not satisfactorily heat the spa water.

Thus, there exists a need for a pool and spa heating system that is less expensive to operate than those known in the prior art, has higher efficiency, is more reliable and can be used in cold weather.

DISCLOSURE OF INVENTION

It is an object of the present invention to provide a pool heating system that has higher heating efficiency.

It is a further object of the present invention to provide a pool heating system that is lower in cost to operate.

It is a further object of the present invention to provide a pool heating system that is reliable.

It is a further object of the present invention to provide a pool heating system that can be operated in low ambient temperatures.

It is a further object of the present invention to provide a pool heating system that provides the efficiency of a heat pump while being fired by natural gas.

It is a further object of the present invention to provide a pool heating system that has a long life and requires little maintenance.

It is a further object of the present invention to provide a pool heating system that can also be used to heat a spa.

It is a further object of the present invention to provide a pool heating system that does not require a separate supplemental heating system for operation in cold temperatures.

Further objects of the present invention will be made apparent in the following Best Modes For Carrying Out Invention and the appended claims.

The foregoing objects are accomplished in the preferred embodiment of the invention by a pool heating system that is fired by natural gas. The system includes a power circuit and a heat pump circuit.

The power circuit uses refrigerant material as a working fluid. The refrigerant is heated and vaporized in a gas fired heater. The vaporized refrigerant is passed from the heater to a power unit. The vaporized refrigerant passes through a slide valve in the power unit and is directed to a driving end of the power unit. The driving end of the power unit has an enclosed first chamber wherein a first piston is movably mounted. The first piston supports a rolling diaphragm made of resilient flexible material.

The piston and rolling diaphragm divide the first chamber into a first end and a second end. The slide valve of the power unit alternatively delivers vaporized refrigerant from the heater to the first side of the chamber, and then exhausts the first side of the chamber. This causes the diaphragm and the piston to move longitudinally in a first direction as pressure is applied and then to return in the opposite direction due to forces later explained as the refrigerant is exhausted.

The refrigerant material exhausted from the first chamber is directed to a first heat exchanger. The first heat exchanger is in heat transfer relation with the pool water. Heat is delivered from the refrigerant to the water in the first heat exchanger and the refrigerant condenses to a liquid.

The liquid refrigerant then flows from the first heat exchanger through a positive displacement pump. The positive displacement pump directs the refrigerant back to the heater. This completes the power circuit of the system.

The heat pump circuit includes a compressor means for compressing vaporized refrigerant material which flows in the heat pump circuit. The compressor means includes a second chamber in a driven end of the power unit. A second piston movably mounted in the second chamber supports a rolling diaphragm therein. The piston and diaphragm divide the second chamber into a front side and a back side. The piston in the second chamber is connected to the piston in the first chamber by a rod. As a result the pistons in the driving and driven ends of the power unit move together.

Movement of the piston in the driving end by the introduction of vaporized refrigerant causes the second piston to compress the refrigerant vapor in the front side of the second chamber. The compressed refrigerant is pumped from the second chamber through a check valve to the remainder of the heat pump circuit. Vapor pressure from the heat pump circuit acts on the piston in the second chamber and serves to return the piston and rod assembly to begin another stroke when refrigerant vapor is exhausted from the driving end. Thereafter as refrigerant is again delivered to the driving end by the power circuit, the pistons begin another stroke. This continues and causes the pistons to undergo reciprocating action.

The high pressure refrigerant pumped from the compressor means of the driven end of the power unit is passed to a second heat exchanger. The second heat exchanger is in fluid communication with the pool water. In the second heat exchanger, heat is transferred from the refrigerant material in the heat pump circuit to the pool water, and the refrigerant material condenses therein.

In the preferred embodiment of the invention, the first and second heat exchangers are housed in a single body. The body is made of plastic material to avoid corrosion and provide long life. A control valve is provided to control the flow of pool water through the heat exchangers. The control valve operates to provide less flow to the first heat exchanger when the pool water is very cold. This avoids cooling the water in the power circuit beyond the heating capability of the heater.

From the second heat exchanger the liquid in the heat pump circuit is passed through expansion means. Thereafter the fluid is passed to an evaporator. The evaporator is in heat transfer relation with the atmosphere and absorbs heat therefrom. As heat is absorbed the refrigerant material again vaporizes. It is then passed through an accumulator to further separate any liquid from the refrigerant vapor, and is then conducted back to the compressor means in the driven end of the power unit. This completes the power circuit.

The preferred embodiment of the invention also includes a bypass for the first heat exchanger. The bypass enables directing the vaporized refrigerant in the power circuit to a third heat exchanger which heats only the water in a hot tub or spa. This enables heating the spa in ambient temperatures below which the heat pump circuit would be ineffective.

The high efficiency pool heating system of the present invention may provide coefficients of performance in the range of 7:1, uses less expensive natural gas fuel, is reliable and requires little maintenance.

BEST MODES FOR CARRYING OUT INVENTION

Figure 1:
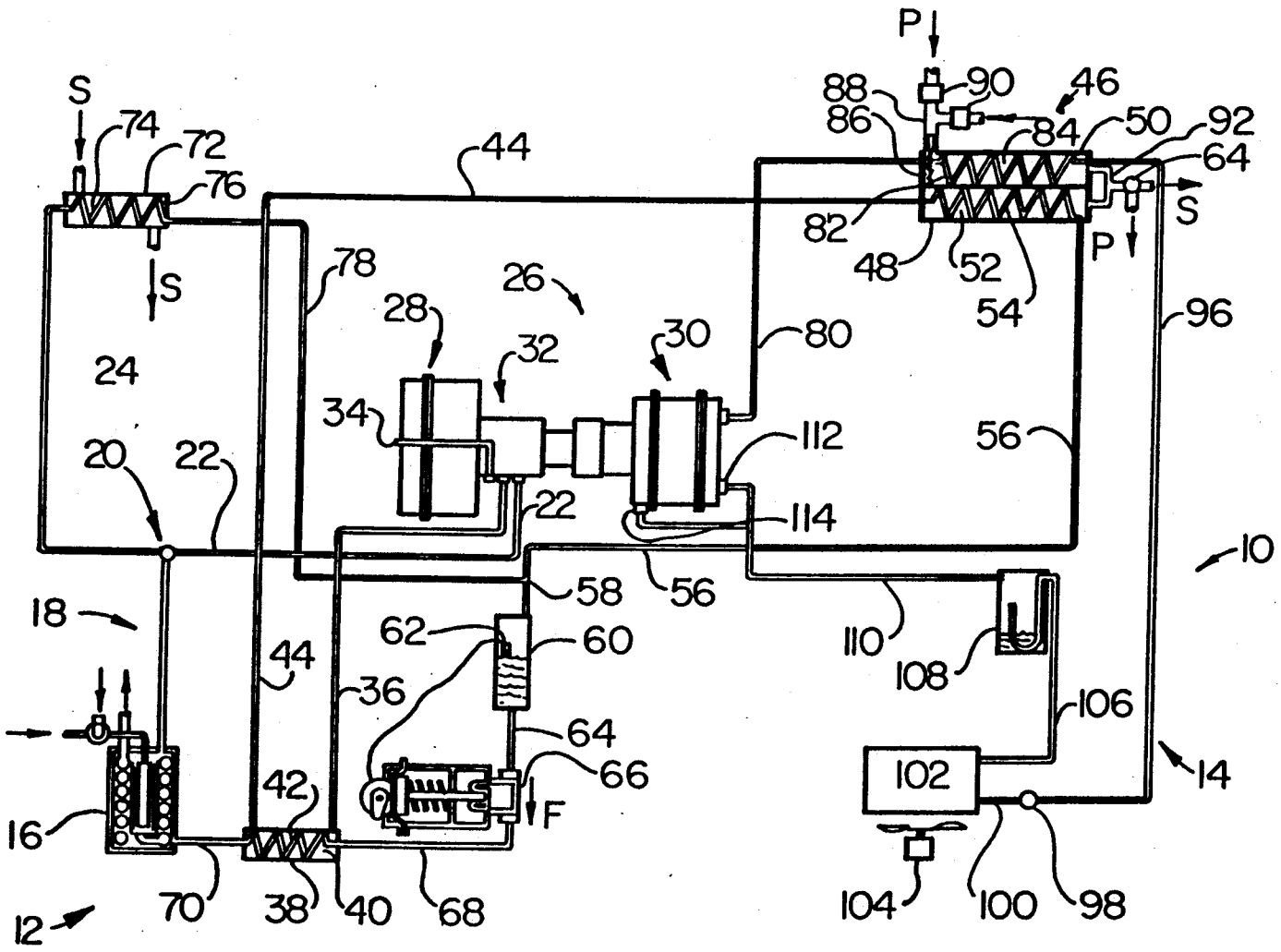
FIG. 1 is a schematic view of the preferred embodiment of the high efficiency pool heating system of the present invention.

Referring now to the drawings and particularly to FIG. 1, there is shown therein a schematic view of the preferred embodiment of the high efficiency pool heating system of the present invention, generally indicated 10. The system includes a power circuit generally indicated 12 and a heat pump circuit generally indicated 14.

The power circuit includes a gas fired heater 16 which heats a first working fluid therein. In the preferred form of the invention the first working fluid is R-22 refrigerant. The refrigerant is vaporized in heater 16 and passed through a conduit 18 to a first three-way valve 20. Valve 20 selectively delivers the vaporized refrigerant to a conduit 22 or to a conduit 24.

Conduit 22 is connected to a power unit 26 which is later described in detail. Power unit 26 includes a driving section 28, a driven section 30 and a valve section 32. Refrigerant vapor is delivered by conduit 22 to valve section 32. Valve section 32 directs the refrigerant vapor periodically in a manner later described in detail, to a conduit 34 where it is used to power driving section 28 of the power unit 26.

Vaporized refrigerant that has been used to power driving section 28 is passed out of valve section 32 to a conduit 36. Conduit 36 is connected to a heat exchanger 38. Heat exchanger 38 is a shell and tube type heat exchanger wherein the refrigerant from conduit 36 passes through a shell 40 on the outside of a tube 42. Heat exchanger 38 is constructed with a metal outer shell with an internal spiraled tube of copper material. This construction provides for excellent heat transfer between the fluids in the shell 40 and the tube 42.

From shell 40 of heat exchanger 38 the refrigerant in the power circuit passes through another conduit 44 to a compound heat exchanger 46. Heat exchanger 46 is a multiple shell and tube type exchanger and has a construction that is later described in detail. Heat exchanger 46 has a first heat exchanger portion 48 and a second heat exchanger portion 50.

First heat exchanger portion 48 has a shell 52 with a tube 54 extending therethrough. Vaporized refrigerant from conduit 44 is passed through tube 54 of the first exchanger portion. Water from a pool or spa to be heated is passed through the shell 52 in a controlled manner as later described. As a result the refrigerant vapor in tube 54 delivers heat to the water and is condensed.

The cooled refrigerant material which is mostly condensed in the heat exchanger, leaves tube 54 and passes into a conduit 56. Conduit 56 includes a tee 58 the purpose of which is later explained. Conduit 56 is connected to a receiver 60. Liquid refrigerant is collected in receiver 60. A float-type sensor switch generally indicated 62, is mounted in receiver 60.

Receiver 60 is in connection with a conduit 64. Conduit 64 is in connection with a pump 66. Pump 66 is a small electric motor driven diaphragm pump which includes internal check valves. The pump provides flow in the direction of Arrow F as shown. Pump 66 is operated in response to float switch 62 which detects the presence of fluid in receiver 60. Control of pump 66 by the sensor insures that the pump operates only when liquid is present and avoids flashing the refrigerant liquid in the receiver 60 to a vapor.

The liquid refrigerant passes out of pump 66 into a conduit 68. Conduit 68 is in connection with tube 42 of heat exchanger 38. As the liquid refrigerant passes through tube 42 it absorbs heat from the refrigerant vapor in the shell 40. From heat exchanger 38 the liquid refrigerant passes through another conduit 70 which delivers it back to heater 16. This completes the power circuit.

The power circuit 12 also includes a heat exchanger 72. Heat exchanger 72 is in fluid communication with conduit 24. Vaporized refrigerant is delivered to heat exchanger 72 when first three-way valve 20 is positioned so that refrigerant vapor is not being delivered to the power unit 26.

Heat exchanger 72 has an internal tube 74 through which vaporized refrigerant passes. Heat exchanger 72 also has a shell 76. Water from a spa to be heated is passed through shell 76 of heat exchanger 72 as indicated by Arrows S. The vaporized refrigerant passing through tube 74 condenses as it transfers heat to the water passing through shell 76. The condensed refrigerant passes out of heat exchanger 72 into a conduit 78. The refrigerant is then passed through tee 58 and is delivered to receiver 60. From receiver 60 the now liquefied refrigerant passes back to heater 16 in the manner previously described.

As explained later, heat exchanger 72 is used to heat water in a spa during cold weather conditions when use of the heat pump circuit would be inefficient.

Heat pump circuit 16 includes the driven section 30 of power unit 26. Driven section 30 comprises a compressor means for pumping a vapor of a second working fluid. In the preferred embodiment the second working fluid is also R-22 refrigerant material.

The driven section 30 of the power unit 26 operates from power delivered from the driving section, as later explained in the detailed description of the power unit. The refrigerant working fluid in the heat pump circuit is compressed and pumped out of the power unit through a check valve (not separately shown) into a conduit 80. Conduit 80 delivers the refrigerant vapor to second heat exchanger portion 50 of compound heat exchanger 46. The refrigerant passes through a tube 82 in the second heat exchanger portion. Water from the pool or spa to be heated passes through a shell 84 of the second heat exchanger portion as indicated by Arrows S and P.

Shell 84 of the second heat exchanger portion 50 is in fluid communication with shell 52 of the first exchanger portion 48 through a control valve 86. Control valve 86 operates in a manner later described to deliver water to the first heat exchanger portion 48 in increasing amounts as the temperature of the water to be heated increases. Control valve 86 serves to avoid cooling the refrigerant in the power circuit beyond the heating ability of heater 16 when the water is very cold.

Water piping 88 to heat exchanger 46 includes check valves 90 to prevent reverse flow. Also, outlet piping 92 from heat exchanger 46 includes a second three-way valve 94 which operates to direct the heated water to the pool or the spa under control of a controller in a manner later explained.

Refrigerant vapor which passes heat to the water flowing through second heat exchanger portion 50 condenses and passes out of the heat exchanger into a conduit 96. Conduit 96 is connected to a flow limiter 98 which serves as expansion means. Although a flow limiter is used in the preferred embodiment of the system of the present invention, it will be understood by those skilled in the art that in other embodiments an expansion valve, capillary tube or other types of expansion means may be used.

Flow limiter 98 is connected to another conduit 100 which carries the expanded refrigerant material to an evaporator 102. Evaporator 102 is a conventional heat exchanger means in which heat from the ambient air is absorbed by the refrigerant which causes it to vaporize. To aid in heat transfer from the air to the refrigerant, the evaporator 102 includes a blower 104 for passing air through the evaporator.

The vaporized refrigerant from evaporator 102 passes through a conduit 106 to a suction accumulator 108. Accumulator 108 serves as means for separating any liquid refrigerant that passes into the accumulator and insures that only vapor passes out of the accumulator.

Refrigerant vapor passes out of accumulator 108 to a conduit 110. Conduit 110 is connected to an inlet 112 of the driven section 70 of the power unit 26. The vaporized refrigerant material is again compressed and passes through the power circuit. Conduit 110 is also in connection with an equalization port 114 of power unit 26. The purpose of the equalization port will be made apparent in conjunction with the detailed description of the power unit.

Figure 2:
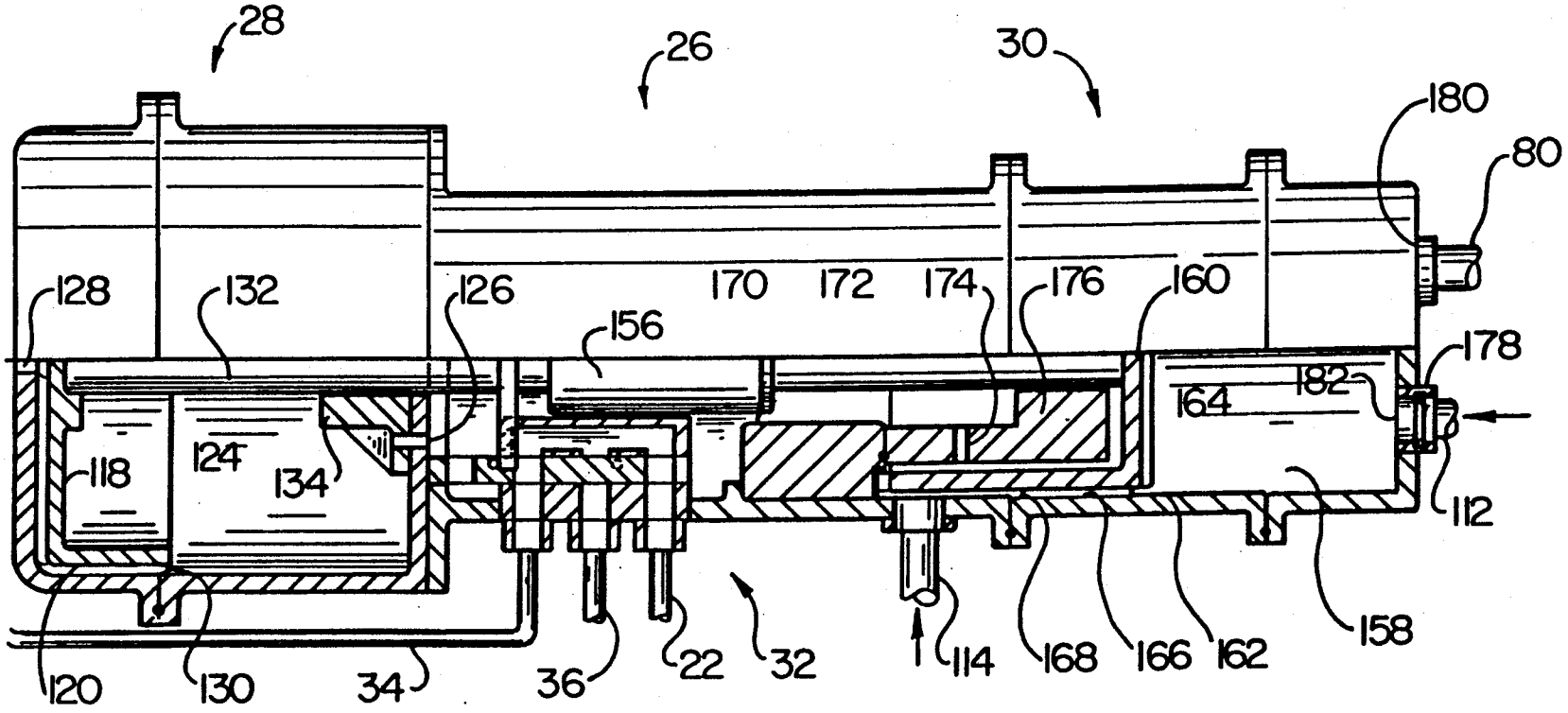
FIG. 2 is a partially sectioned view of the power unit with the first piston positioned at the beginning of a power stroke.
Figure 3:
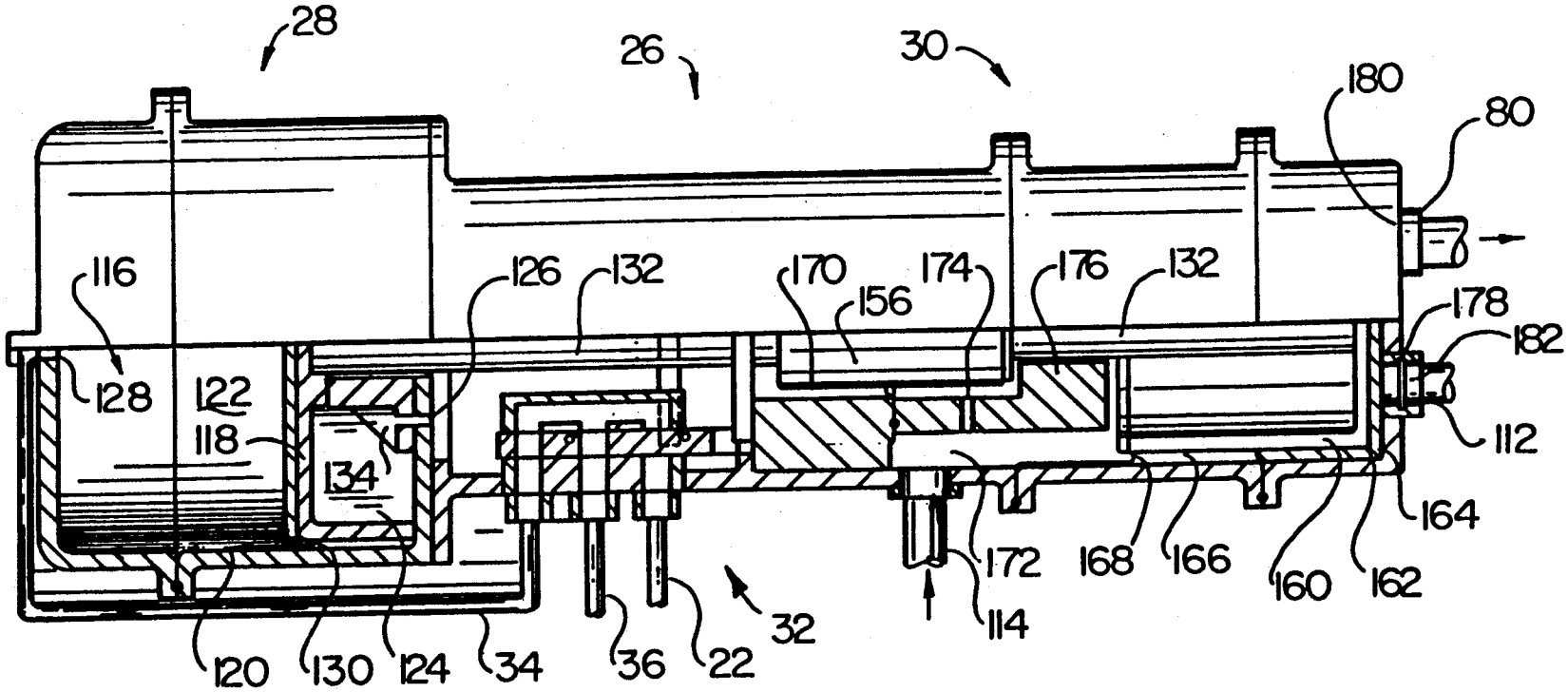
FIG. 3 is a partially sectioned view of the power unit with the first piston positioned at the beginning of a return stroke.

A novel aspect of the system of the present invention is the power unit 26 which is shown in detail in FIGS. 2 and 3. The driving section 28 of the power unit has an enclosed first chamber 116. A first piston 118 is positioned in the first chamber and is movable longitudinally therein. First piston 118 is a split piston which has a detachable face.

A first rolling diaphragm 120 is supported on piston 118. Rolling diaphragm 118 is of the fabric elastomer type and in the preferred embodiment is manufactured by Bellofram. In the preferred form of the invention the rolling diaphragm is designed to withstand temperatures of 500 degrees F. and pressures of 1500 PSI. The rolling diaphragm is captured between the face and the main body of piston 118 and moves with the piston to provide a seal between the outer wall bounding chamber 116 and the piston. The rolling diaphragm provides a seal with virtually no frictional resistance to movement.

Rolling diaphragm 120 divides first chamber 116 into a first side 122 and a second side 124. Second side 124 is open to atmosphere through an opening 126 in the housing of the power unit 26. In other embodiments, second side 124 may be directed through a valve mechanism to a condenser or similar heat exchanger. This would capture any refrigerant that may leak through the diaphragm.

Valve section 32 of power unit 26 which is later described in detail, is connected to conduit 34. Conduit 34 is connected to an opening 128 which is open to the first side of chamber 116. Valve section 32 in a first condition supplies vaporized refrigerant from heater 16 to the first side 122 of the piston 118. In this first condition of the valve section shown in FIG. 2, the piston is pushed towards the right by the fluid pressure of the vaporized refrigerant.

In a second condition of the valve section 32 shown in FIG. 3, flow from the heater into the power unit is prevented. At the same time first side 122 and conduit 134 are open to conduit 36, which carries refrigerant to heat exchanger 28. As a result refrigerant exhausts from first chamber 116. With the pressure of the refrigerant vapor relieved, piston 118 is no longer pushed to the right as shown in FIG. 3. As a result the piston is enabled to move to the left in response to forces applied by the driven end 30 of the power unit 26 as later explained. Due to the repeated cycling of valve means 32, piston 118 reciprocates back and forth in the first chamber.

Rolling diaphragm 120 provides an advantage in the construction of power unit 26 in that it provides a fluid tight seal for piston 118 and yet poses little resistance to movement. The rolling diaphragm is also durable. This is because the rolling diaphragm 120 is supported by adjacent surfaces at all points except in small folds 130 which extend about the periphery of the piston plate. This lowers the force applied to the rolling diaphragm and minimizes the risk of rupture.

Piston 118 is connected to a rod 132 which extends from the piston through the second side 124 of the first chamber. Rod 132 is supported in a bearing 134 at the rear of the driving section 28. Bearing 134 enables rod 132 to move longitudinally with piston 118.

Rod 132 extends through valve section 32. Valve section 32 is shown in greater detail in FIGS. 4 through 7. Valve section 32 has a valve body 136. Valve body 136 is attached to a manifold 138 which is connected to conduits 22, 36 and 38 as shown. A slide 140 is movably mounted in valve body 136. Slide 140 includes first, second and third passages 142, 144 and 146 respectively. Slide 140 also has a first pin 148 extending outward therefrom on a first side and a second pin 150 extending therefrom on an opposed side from pin 148.

A first trip arm 152 extends from rod 132 on a side of the rod where first pin 148 is located. A second trip arm 154 extends from rod 132 on an opposed side where second pin 150 is located.

Figure 4:
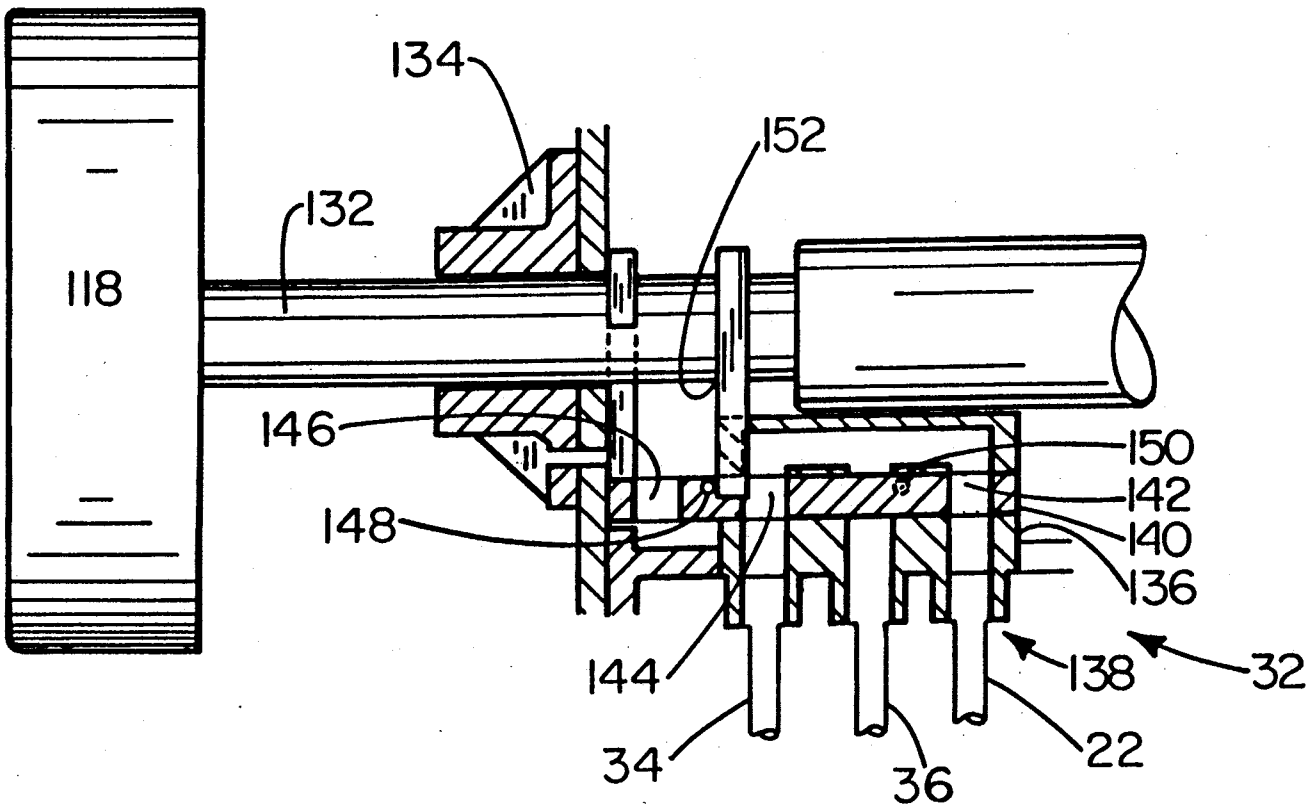
FIG. 4 is a partially sectioned view of the slide valve of the power unit shown in its position when the first piston is in a power stroke.
Figure 5:
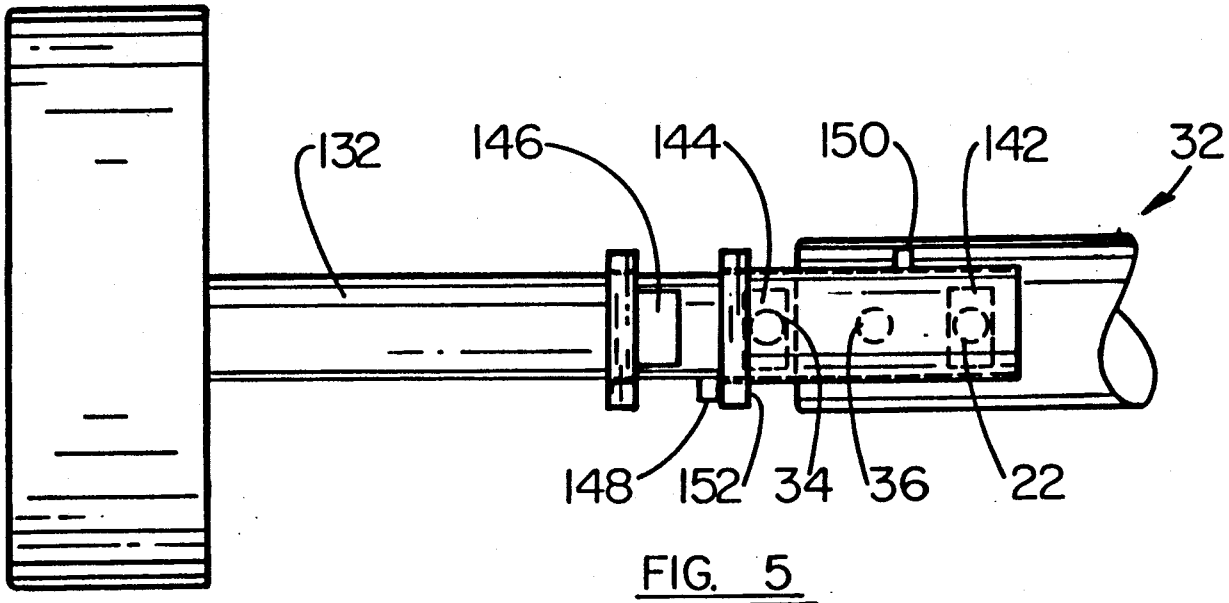
FIG. 5 is a top view of the slide valve in the position shown in FIG. 4.

As shown in FIGS. 4 and 5, when rod 132 is fully extended to the left, trip arm 152 engages first pin 148 and moves slide 140 to the first position. In the first position, first passage 142 enables refrigerant vapor delivered through conduit 22 to pass through a valve body 136 and exit through third passage 144. In this condition vapor is delivered to conduit 34. Refrigerant vapor delivered through conduit 34 enters first chamber 116 and causes piston 118 and rod 132 to move to the right. In this first condition of the valve portion, slide 140 is positioned so that no flow is allowed either into or out of conduit 26.

As piston 118 and rod 132 move to the right, trip arm 152 disengages first piston 148. However, slide 140 continues to maintain its first position continuing the delivery of refrigerant vapor to first chamber 116. Eventually movement of rod 132 causes second trip arm 154 to engage second pin 150. Further movement of rod 132 to the right causes slide 140 to be moved to the second position shown in FIGS. 6 and 7.

In the second position, slide 140 is positioned such that second passage 144 is in connection through valve body 136 with third passage 146. This places conduits 36 and 34 in fluid communication. In the second position of slide 140 flow to conduit 32 is blocked. As a result refrigerant is enabled to flow out of first chamber 116 through conduit 34. Refrigerant vapor passes through the valve portion and exhausts through conduit 36. The release of refrigerant vapor enables piston 118 and rod 132 to be moved back in the direction to the left as shown in response to forces applied to the rod by the driven end of the power unit.

Figure 6:
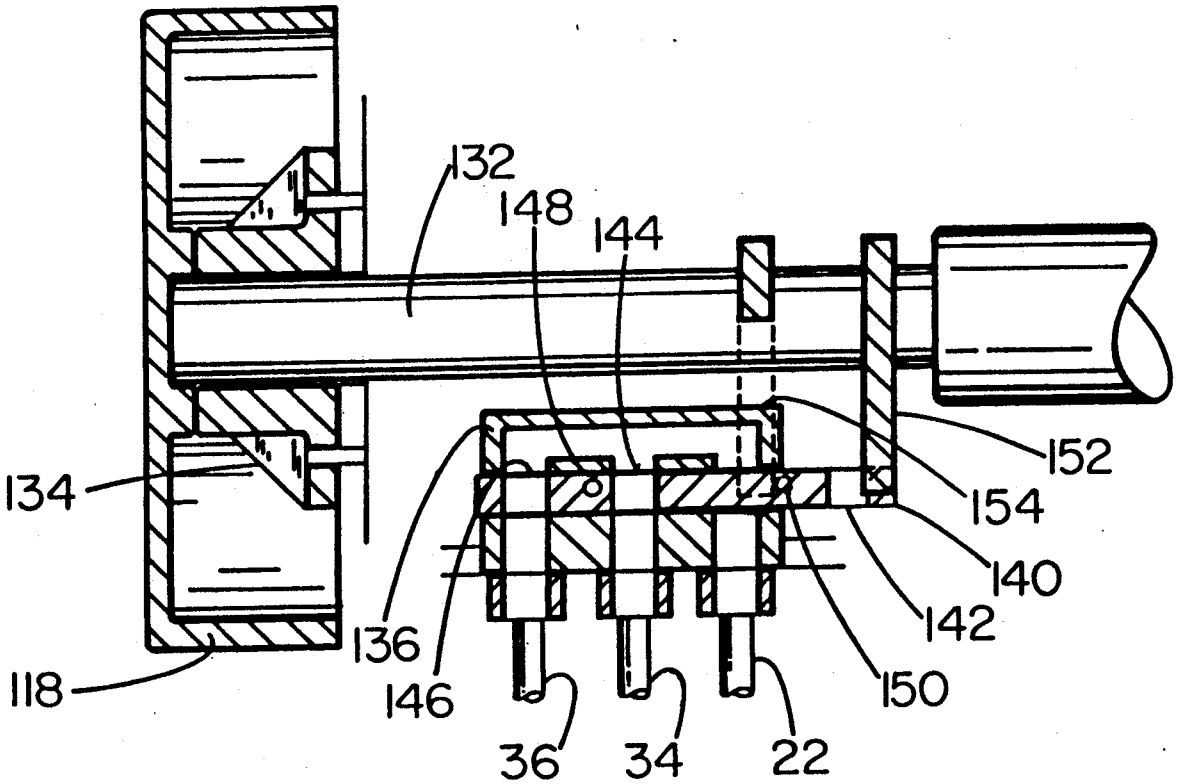
FIG. 6 is a partially sectioned view of the slide valve of the power unit shown in its position when the piston is in a return stroke.
Figure 7:
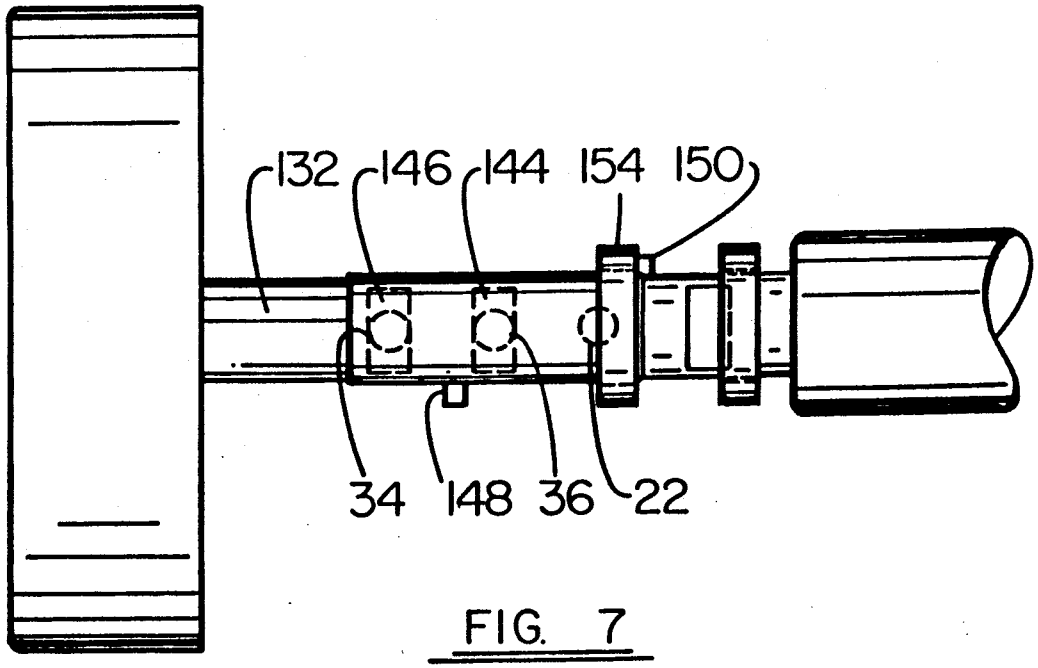
FIG. 7 is a top view of the slide valve in the position shown in FIG. 6.

Valve section 132 remains in the second condition shown in FIGS. 6 and 7 until rod 132 is fully moved to the left, and slide 140 again moves toward the position shown in FIGS. 4 and 5. As the rod moves, the first trip arm 152 moves pin 148 and slide 140 to the first position so that refrigerant is again supplied to the first side of the piston. The cycle is then repeated causing piston 118 to reciprocate.

In the preferred embodiment of the invention slide 140 and the abutting surfaces of the valve body, are made of ceramic material that is lapped to very close tolerances. The adjacent surfaces are held together by spring pressure supplied by leaf springs (not shown) to provide a good seal while enabling the slide to readily move between the first and second positions. As will be understood by those skilled in the art, in other embodiments of the invention other types of valves may be used.

Referring again to FIGS. 2 and 3, the driven section 30 of the power unit is hereafter described. Rod 132 includes an enlarged section 156 which divides the driving section 28 and the driven section 30. The driven section 30 includes a second chamber 158 in which a split second piston 160 is positioned. Second piston 160 is sized to be movable in chamber 158 and is attached to rod 132 for movement therewith.

A second rolling diaphragm 162 extends across second chamber 158 and is supported on piston 160. Rolling diaphragm 162 is of similar material to rolling diaphragm 120. Rolling diaphragm 162 divides chamber 158 into a front side 164 and a back side 166.

An isolating diaphragm 168 extends across the back of piston 160 and bounds back side 166. A return diaphragm 170 extends across enlarged portion 156 of rod 132. Rod 132 is manufactured to include means for splitting the rod in the area of diaphragm 170. This enables the rod to pass through an opening in diaphragm 170 while still maintaining a fluid tight seal.

Diaphragms 168 and 170 are both rolling diaphragms and bound a third chamber 172. As represented schematically by passage 174, third chamber 172 extends on both sides of a bearing support 176 which supports rod 132 in the driven section while enabling it to move longitudinally.

As shown in FIGS. 2 and 3, equalization port 114 is open to third chamber 172. This results in the pressure of the refrigerant in the accumulator pushing against second piston 160. This pressure tends to help move the piston to the right when rod 132 is moved in that direction. The pressure in third chamber 172 also provides force in an opposed direction through action on diaphragm 180 which aids in moving rod 132 to the left as well.

Front side 164 of driven end 30 is also in fluid communication with conduit 80 and inlet 112 through openings 180 and 182 respectively. Positioned in openings 180 and 182 are check valves 178, only one of which is shown. Check valves 178 are metal flapper type check valves which, in the preferred embodiment, are of the type made by the De-Sta-Co Division of Dover Company. The valve positioned in opening 182 permits flow only into front side 164 of chamber 158. Likewise the valve in opening 180 only permits flow out of the front side of the chamber.

Refrigerant vapor from accumulator 108 enters front side 164 through check valve 178 in opening 182. As fluid is entering opening 182, the check valve in opening 180 is closed. The pressure of the refrigerant in the first side 164 as well as pressure in the third chamber 162, tend to move piston rod 132 to the left as refrigerant is exhausted from first chamber 116 by valve section 32. As a result, first side 164 of the driven section fills with refrigerant vapor as piston 160 and rod 132 move to the left. Eventually front side 164 fills with refrigerant vapor when piston 160 moves fully to the left.

When valve section 32 changes its condition so that refrigerant vapor is again delivered to the driving section of the power unit, piston 118 begins moving to the right. Because piston 160 is connected through rod 132 to piston 118, piston 160 also begins moving correspondingly to the right. As a result, the refrigerant in front side 164 of the driven section is compressed. The check valve 178 in opening 180 opens in this condition while the oppositely directed check valve in opening 182 closes. As piston 160 moves to the right assisted by the pressure in third chamber 172, the refrigerant vapor is forced out of the driven section and into conduit 80. The working fluid then travels to the remainder of the heat pump circuit.

When pistons 160 and 118 reach the full extent of their travel to the right, valve section 32 reverses its condition as previously described, and refrigerant vapor is again exhausted from the driving section of the power unit. At the same time refrigerant vapor begins entering the driven section of the power unit as the piston assembly moves back to the left. This cycle is repeated periodically by the power unit which efficiently uses the power of the refrigerant vapor in the power circuit to compress the refrigerant vapor in the heat pump circuit.

Power unit 26 provides a high efficiency compressor with limited losses due to its rolling diaphragm construction. It is also a reliable component because of its simplicity and limited number of moving parts.

Figure 8:
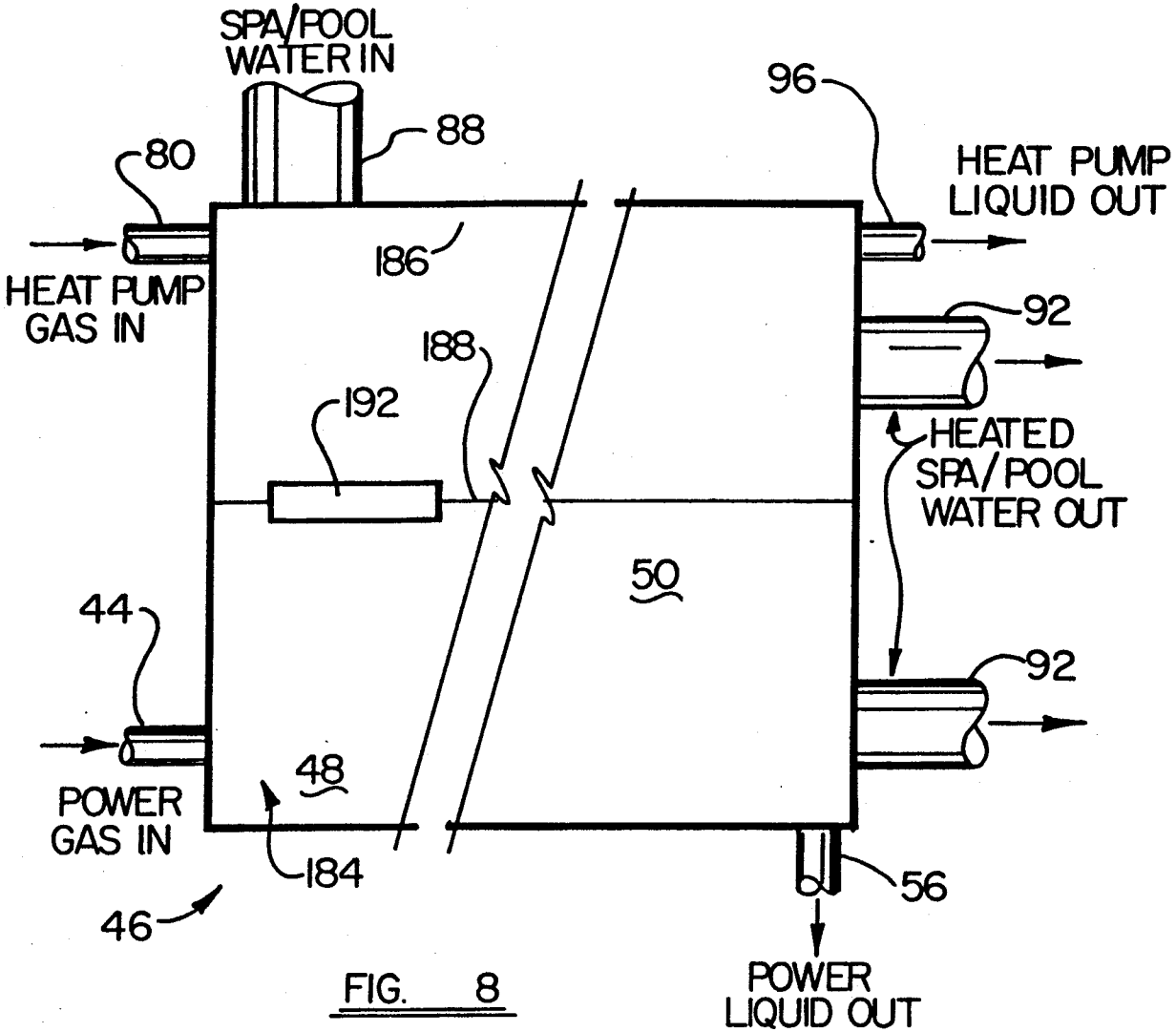
FIG. 8 is a side view of the compound heat exchanger assembly of the preferred embodiment of the system of the present invention.
Figure 9:
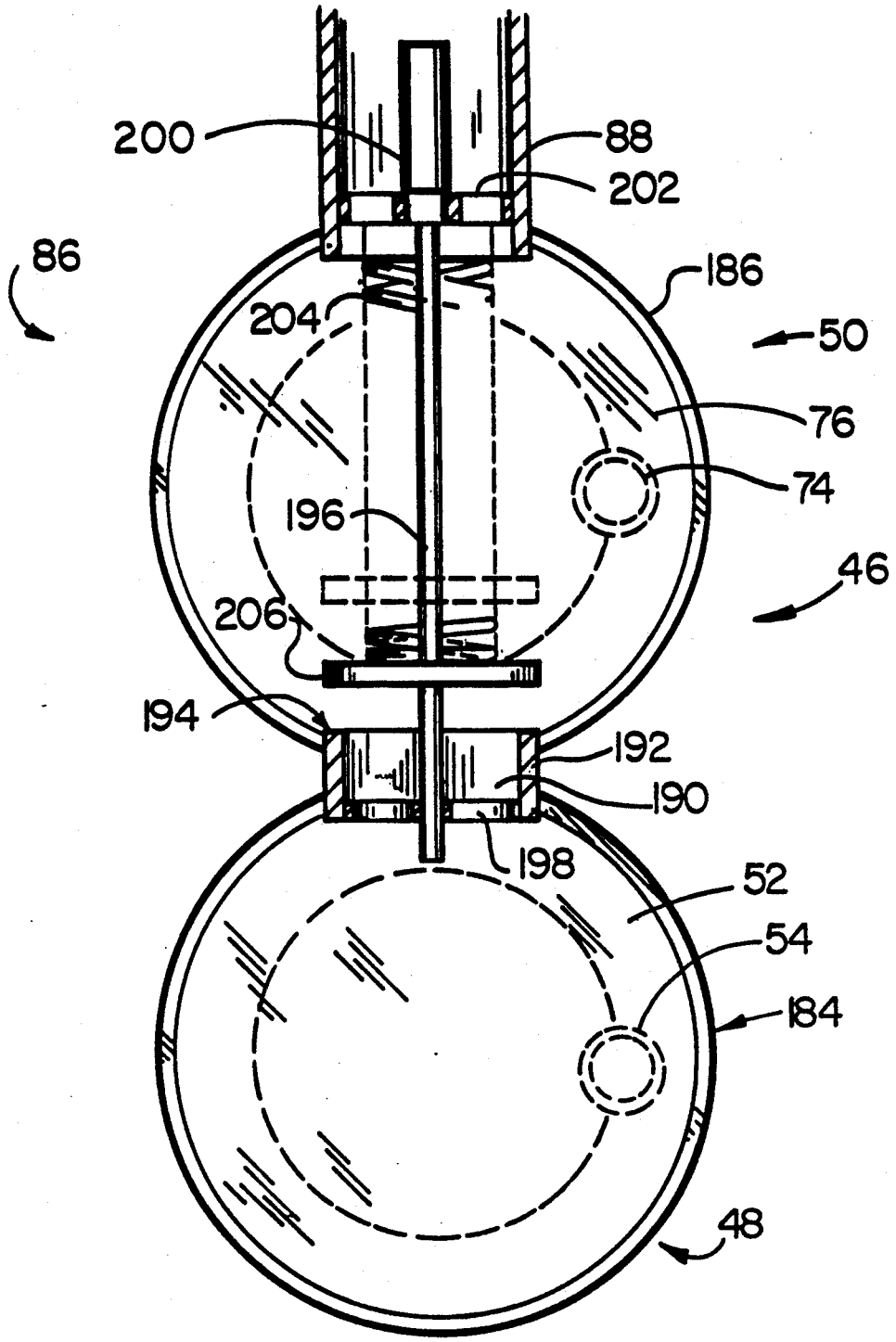
FIG. 9 is a partially sectioned view of the compound heat exchanger and the control valve housed therein.

A further novel aspect of the high efficiency pool heating system of the present invention is the construction of the compound heat exchanger 46 which is shown in detail in FIGS. 8 and 9. First heat exchanger portion 48 and second heat exchanger portion 50 have cylindrical housings 184 and 186, respectively. Housings 184 and 186 are joined along a seam 188. In the preferred form of the invention, housings 184 and 186 are made of plastic material to avoid corrosion.

Tube 54 of the first heat exchanger portion 48 carries refrigerant therein. In the preferred form of the invention tube 54 is a spiral tube of cupra-nickel material. Water from the pool or spa to be heated passes through the shell 54 of the first heat exchanger portion and cools the refrigerant vapor in tube 54 causing the refrigerant to condense.

Second heat exchanger portion 50 in the preferred embodiment also has a spiral tube 74 of cupra-nickel material which carries refrigerant vapor in the heat pump circuit. Water from the spa or pool passes in the shell 76 on the inside of housing 186 to condense the refrigerant flowing in tube 74.

Housings 184 and 186 are not in fluid communication except through an opening 190. The flow through opening 190 is controlled by control valve 86. Opening 190 is bounded by a nipple 192 having a top flange 194. An actuator rod 196 extends through the center of opening 190 and is supported therein by a support plate 198 which has openings (not separately shown) through which water may flow. Rod 196 is vertically movable in an opening in support plate 198.

Actuator rod 196 is connected to a temperature responsive actuator 200. Actuator 200 is mounted in the incoming water piping 88 to sense the temperature thereof. In the preferred embodiment of the invention, actuator 200 is a wax driver which houses a wax that expands and contracts to move rod 196 upward with increasing temperature and downward with decreasing temperature. Actuator 200 is mounted on a support plate 202. A compression spring 204 is mounted in abutting fashion with support plate 202. The opposed end of compression spring 204 abuts a valve disk 206 which is fixably mounted on rod 196.

In operation of control valve 86, when the water entering the compound heat exchanger from the pool or spa is cold, valve disk 206 is only slightly disposed from the top flange 194 of nipple 192. As a result most of the water flowing into compound heat exchanger 46 from water piping 88 flows into the second heat exchanger portion 50 and is heated by the refrigerant in the heat pump circuit.

As the water temperature increases the actuator 200 moves rod 196 upward against the force of spring 204. Valve disk 206 moves to the position shown in phantom increasing the flow of water to the first heat exchanger portion 48. As a result, the incoming water is more evenly split between the heat exchanger portions.

Control valve 86 functions to help the system operate more effectively when the water to be heated is cold. If the refrigerant in the power circuit were allowed to cool beyond the heating ability of the heater 16, the power unit would not run the heat pump circuit as effectively. Avoiding overcooling of the refrigerant in the power circuit insures that better performance is achieved when the system begins operating when the water is very cold.

Figure 10:
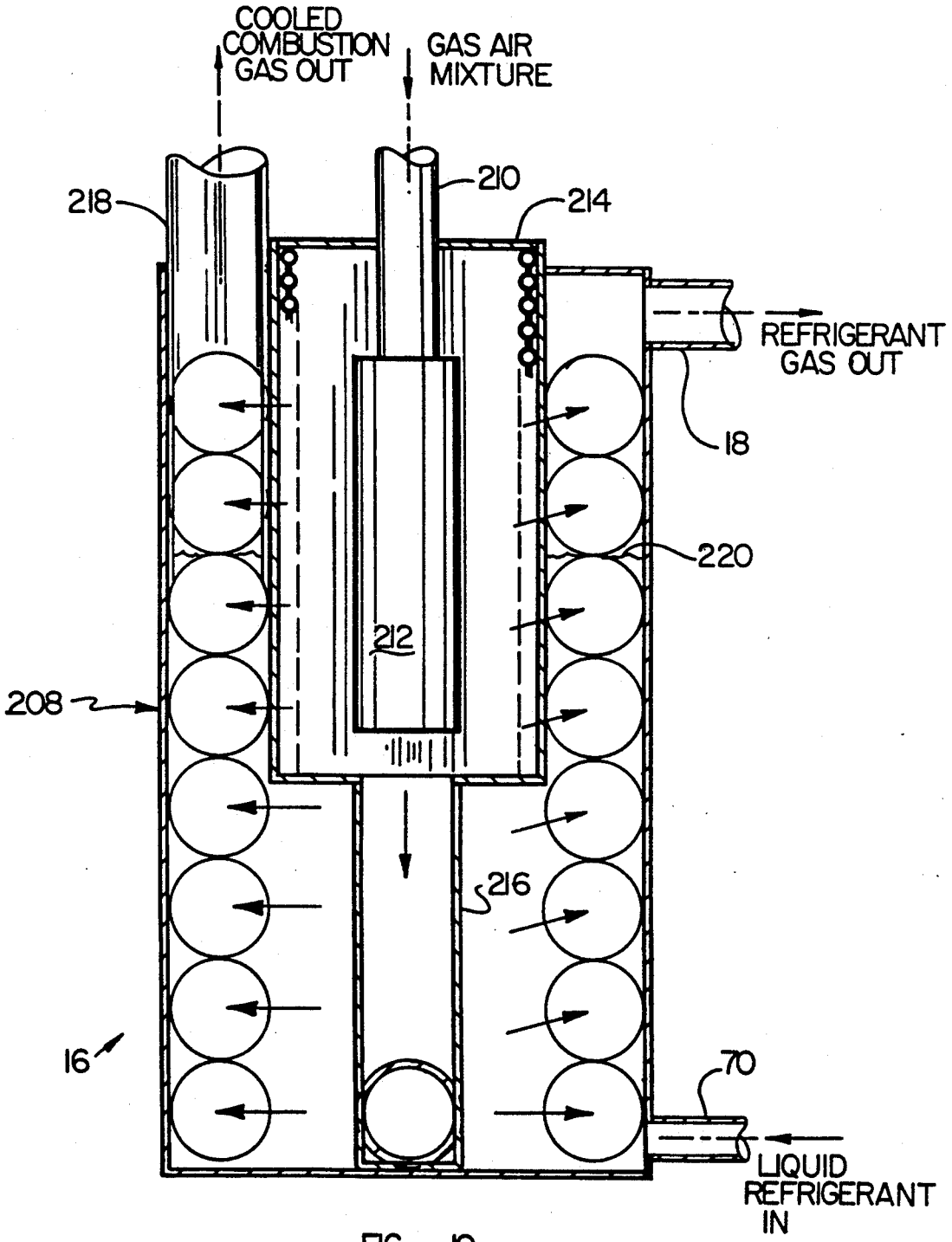
FIG. 10 is a sectional view of the gas fired heater of the power circuit.

The heater 16 of the high efficiency pool heater system is also novel in many aspects. It is shown in detail in FIG. 10. The heater 16 has a housing 208 of stainless steel material. A natural gas and air mixture is injected into the heater through an inlet tube 210. The mixture is ignited in a porous ceramic burner 212. The burner is housed in a radiation shield 214 which is made from 29-4C stainless steel.

The hot products of combustion pass from the burner in a tube 216 which spirals outward and upward inside housing 208. The products of combustion are cooled by the refrigerant which surrounds tube 216 inside the housing. The cooled products of combustion exit the heater through a stack 218.

Liquid refrigerant in the power circuit enters housing 208 at the bottom of the heater through conduit 70. The refrigerant is heated by contact with the outside of tube 216 and vaporizes at an interface shown schematically at 220. The vaporized refrigerant then exits the housing through conduit 18.

Heater 16 is a high efficiency unit that effectively transfers the heat of combustion of the natural gas to the refrigerant material. It also produces little pollution, including less than 20 parts per million of NOX.

Of course while natural gas is used in the preferred form of the system of the present invention as a fuel source for the heater, in other embodiments other hydrocarbon fuels may be used.

Figure 11:
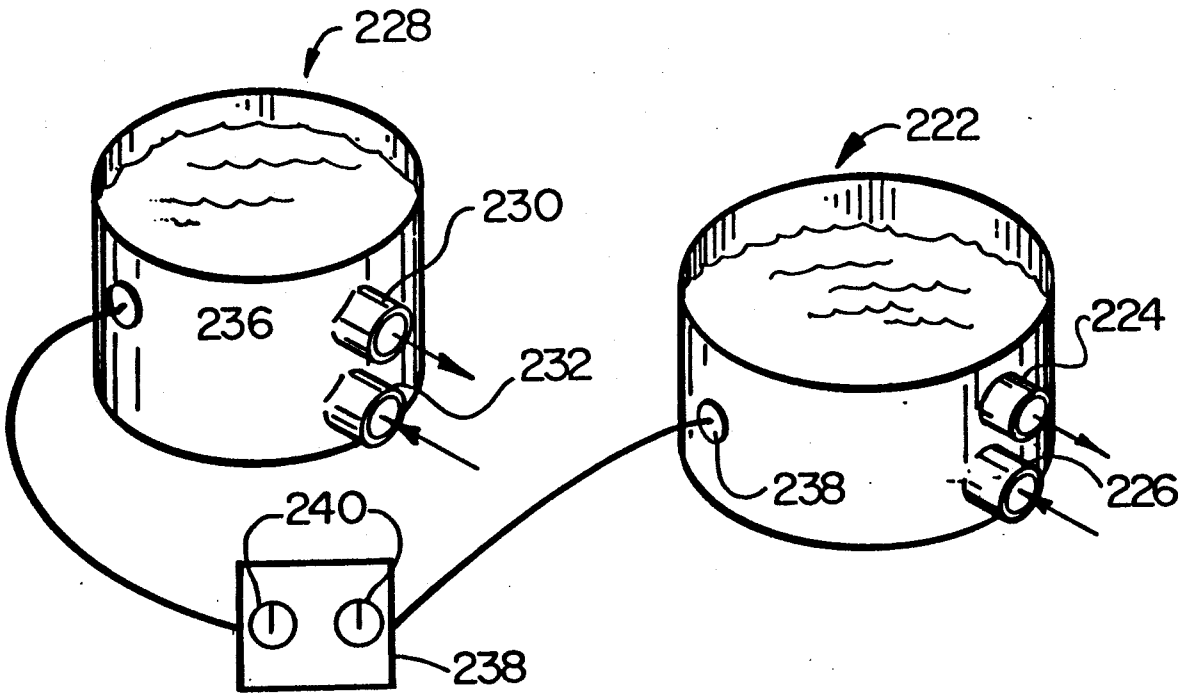
FIG. 11 is a schematic view of a pool, a spa and a temperature controller for controlling the temperature of the water in the pool and spa.

A system for controlling the operation of the high efficiency pool heating system is described with reference to FIGS. 11 and 12. FIG. 11 shows a pool 222 and the water therein. Ducts 224 and 226 for delivering and receiving water from the system respectively, are shown schematically on the side of the pool. A spa 228 and the water therein is also shown. Spa 228 also has ducts 230, 232 for delivering and receiving water from the pool heating system of the present invention, respectively.

A temperature sensor 234 is positioned in the water of the pool to sense its temperature. It will be understood by those skilled in the art that the sensor 234 need not be in the pool but may be conventionally mounted in the water ducts. Likewise spa 228 has a temperature sensor 236 for sensing the temperature of the water therein.

Sensors 234 and 236 are electrically connected to a controller 238. Controller 238 includes inputs (shown schematically as dials 240 and 242) for setting the desired temperature of the water in the spa and pool respectively.

Figure 12:
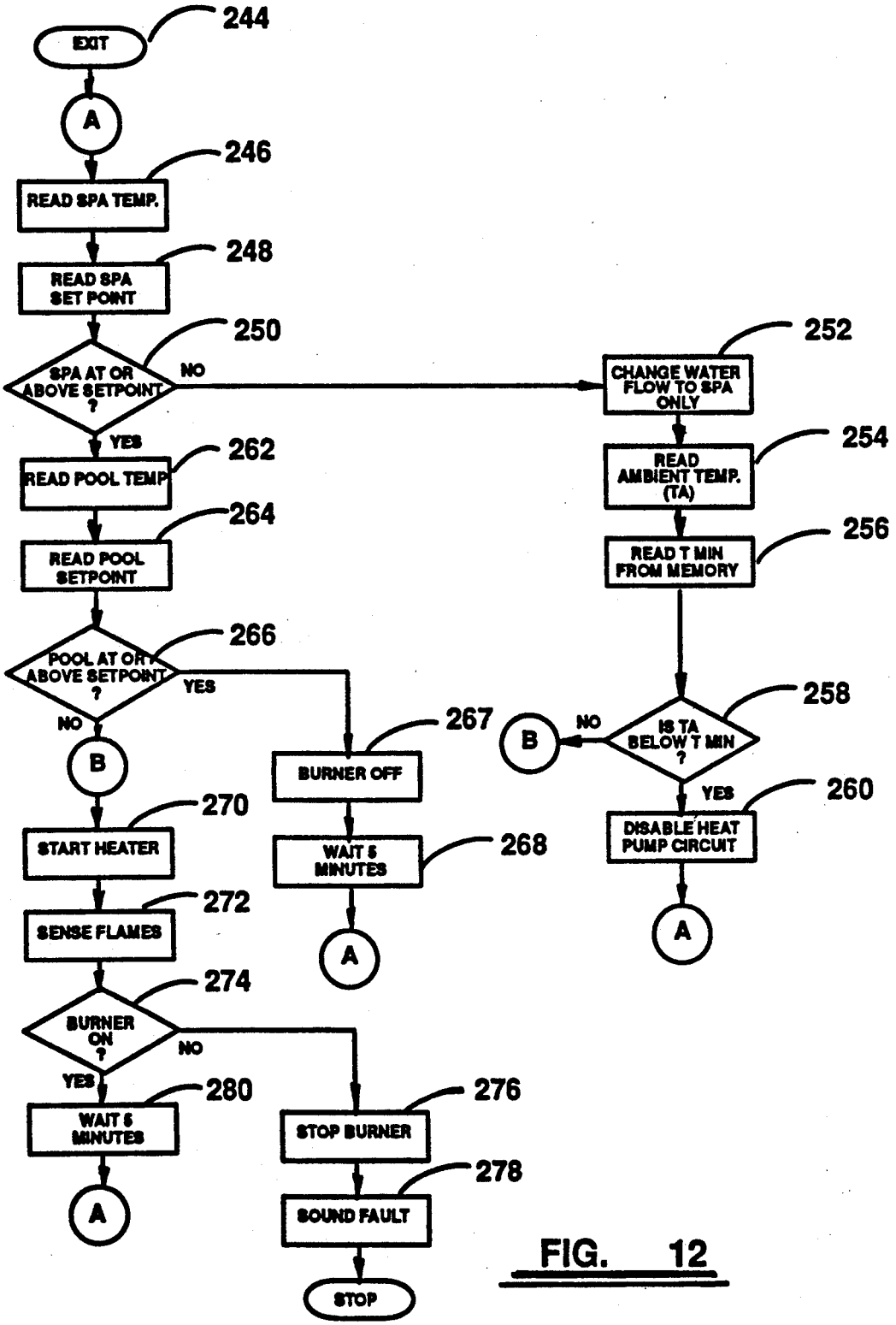
FIG. 12 is a flowchart for a computer program executed by the temperature controller of the preferred embodiment for control of the high efficiency pool heater system of the present invention.

Controller 238 includes a processor and a memory that execute the program steps shown in FIG. 12. From a start point 244 the processor reads the spa temperature from sensor 236 at a step 246. Thereafter, the processor reads the desired temperature of the spa input by the operator, at a step 248. At a decision step 250, the processor compares the temperatures and decides if the spa is at or above the temperature set by the operator.

In accordance with the system of the present invention, the spa is given preference in heating as it holds less water and is likely to be used year round. If the spa is not at the desired temperature, the processor executes a step 252 which changes the system water piping so that only the spa receives water from the system and no heated water is directed to the pool. This step changes the condition of three-way valve 94 so that all the heated water is directed to the spa. Of course as will be understood by those skilled in the art, at the time that the condition of three-way valve 94 is changed, further valving (not shown) is also changed so that water being supplied to the system for heating is taken only from the spa.

Thereafter, the controller executes a step 254 in which it reads the ambient air temperature from a sensor (not shown) in connection with controller 238. This sensor gives the temperature of the ambient air which can be passed through evaporator 102. For purposes of convenience, the ambient temperature is designated "Ta". Of course if the ambient air temperature is too low, the heat pump circuit is not effective. The temperature in which the heat pump is not effective is stored in the controller's memory as "Tmin". At step 256 the processor reads "Tmin" and at step 258 compares the ambient temperature "Ta" to "Tmin".

If the ambient temperature is not too low for effective use of the heat pump circuit, the power and heat pump circuits are controlled as later described. However if the temperature is too low for effective use of the heat pump circuit, the heat pump circuit is disabled at a step 260. This is done by having the processor change the condition of three-way valve 20 so that the working fluid in the power circuit is directed away from power unit 26 and into heat exchanger 72. Heat exchanger 72 heats the water in the spa directly with the working fluid in the power circuit. After changing the condition of three-way valve 20 the controller operates in a manner later described.

In the alternative, if at step 250 the spa is at or above the desired temperature the processor goes on to read the pool temperature from sensor 234 at step 262. The setpoint temperature for the pool set by the operator is read at step 264 and a comparison made at step 266. If the pool is at or above the set temperature, the processor shuts off the heater at step 267 (if the heater is on) and the processor waits five minutes at step 268. The sequence is then repeated to conduct a later test of the water temperatures.

If the pool is not at the set temperature at step 266 (or "Ta" is not below "Tmin" at step 258, or after step 260 has been executed) the processor starts heater 16 at step 270. This actually involves starting the air blower, opening the flow of natural gas and lighting the mixture using an electric starter, all of which operations are well known in the prior art.

In the event of a malfunction, the heater may not light. A flame detector (not shown) is mounted inside the heater. The flame detector provides an electrical indication to the processor of whether a flame is present in the heater. At step 272 the processor checks the signal from the flame detector. At a step 274 the processor then decides if a flame is present. If the heater has failed to light properly, the heater is shut off and a fault alarm sounded at steps 276 and 278 respectively. If the heater is running properly the processor waits five minutes at a step 280. After the heating process has been allowed to proceed for five minutes the processor again runs through the sequence to check the temperatures.

Although not shown in the drawings, it will be understood by those skilled in the art that water pumps are used for moving the water from the pool and the spa through the heat exchangers of the high efficiency pool heating system of the present invention. Likewise those skilled in the art will understand that the system of the present invention also uses conventional valving to direct the water from the impoundments to the heat exchangers to achieve the flows described herein.

Although the present invention uses R-22 refrigerant as a working fluid in the both the power and heat pump circuits, in other embodiments different working fluids may be used. Also the heat pump circuit may employ a different fluid than the power circuit.

Thus, the new high efficiency pool heating system of the present invention achieves the above stated objectives, eliminates difficulties encountered in the use of prior devices and systems, solves problems and obtains the desirable results described herein.

In the foregoing description certain terms have been used for brevity, clarity and understanding, however no unnecessary limitations are to be implied therefrom because such terms are for descriptive purposes and are intended to be broadly construed. Moreover, the descriptions and illustrations are by way of examples and the invention is not limited to the details shown and described.

Having described the features, discoveries and principles of the invention, the manner in which it is constructed and operated and the advantages and useful results obtained, the new and useful structures, devices, elements, arrangements, parts, combinations, systems, equipment, operations and relationships are set forth in the appended claims.

I claim:

1. A system for heating water in at least one of a swimming pool or a spa, comprising:

at least one of swimming pool or spa housing water; and a power circuit including:

hydrocarbon fired heating means for heating and vaporizing a refrigerant material;

a first enclosed chamber;

a first member means movably mounted in said first chamber for movement responsive to pressure of refrigerant material in said first chamber;

first valve means in fluid communication with said heating means and said first chamber for selectively delivering refrigerant material to said first chamber and for exhausting refrigerant material from said first chamber;

first heat exchanger means in fluid communication with said first valve means, said first heat exchanger means receiving refrigerant exhausted from said first chamber, said first heat exchanger means in heat transfer relation with said water and delivering heat from said refrigerant material thereto to condense said refrigerant material to liquid; and pumping means in fluid communication with said first heat exchanger means and said heating means, for pumping liquid refrigerant material from said first heat exchanger means to said heating means; and a heat pump circuit including:

compressor means in mechanically powered connection with said first member means of said power circuit, for compressing vaporized refrigerant material;

second heat exchanger means in fluid communication with said compressor means and receiving compressed refrigerant material therefrom, said second heat exchanger means in heat transfer relation with said water for delivering heat from said refrigerant material thereto to condense said refrigerant material to liquid;

expansion means in fluid communication with said second heat exchanger means for expanding refrigerant material delivered to said expansion means from said second heat exchanger means; and evaporator means in fluid communication with said expansion means and said compressor means, said evaporator means in heat transfer relation with atmosphere, said refrigerant material receiving heat therefrom to vaporize said refrigerant material, whereby vaporized refrigerant material is delivered from said evaporator means to said compressor means;

the system further comprising, third heat exchanger means in heat transfer relation with said water, and bypass valve means in said power circuit for directing said refrigerant in said power circuit through said third heat exchanger means in lieu of said first chamber and said first heat exchanger means.

2. The system according to claim 1 wherein said first member means comprises a first piston means mounted for movement in said first chamber, said first chamber having a first side and a second side, said sides bounded by said first piston means, and wherein said first valve means alternatively delivers and exhaust refrigerant material from said first side of said first chamber, whereby said first piston means is enabled to reciprocate therein.

3. The system according to claim 2 wherein said compressor means of said heat pump circuit comprises:

a second enclosed chamber;

second piston means mounted for movement in said second chamber, said second chamber having a front side and a back side, said sides bounded by said second piston means, said second piston means in mechanical connection with said first piston means and reciprocating in response to movement thereof; and second valve means for alternatively admitting refrigerant material from said evaporator to said front side and for discharging refrigerant material pressurized by movement of said second piston means from said front side for delivery to said second heat exchanger means.

4. The system according to claim 3 wherein said first piston means comprises a first rolling diaphragm for maintaining fluid separation between said first and second sides of said first chamber.

5. The system according to claim 4 wherein said second piston means comprises a second rolling diaphragm for maintaining fluid separation between said front and back sides of said second chamber.

6. The system according to claim 5 and further comprising flow control means in connection with said first heat exchanger means for controlling the flow of water through said first heat exchanger means in response to water temperature.

7. The system according to claim 6 wherein said first and second heat exchanger means include first and second shell and tube type heat exchangers with refrigerant material in the tube portions thereof, and said shells of said heat exchangers are comprised of a unitary enclosure of non-corrosive material.

8. The system according to claim 7 and further comprising disabling means for said heat pump circuit responsive to ambient temperature, whereby said heat pump circuit is inoperative at temperatures below which it would not serve to efficiently heat said water.

9. The system according to claim 8 and wherein said heat pump circuit further comprises:

accumulator means in said heat pump circuit in fluid communication with said evaporator means and said compressor means, for separating liquid refrigerant material from vaporized material and providing vaporized refrigerant material for delivery to the front side of said second chamber.

10. The system according to claim 9 wherein said first piston means includes a first piston supporting said first rolling diaphragm, and said second piston means includes a second piston supporting said second rolling diaphragm, and wherein said first and second pistons are connected by a rod extending between said pistons.

11. The system according to claim 10 wherein said first valve means comprises a reciprocating slide valve, said slide valve alternatively placing said first side of said first chamber in fluid communication with said heating means or said first exchanger means, whereby refrigerant delivered to said chamber moves said first piston means and refrigerant exhausted from said first chamber is delivered to said first heat exchanger means.

12. The system according to claim 11 wherein said second valve means includes a first check valve for admitting refrigerant material to the front side of said second chamber as the area of said front side increases as said second piston reciprocates, and a second check valve for discharging refrigerant material as the area of said front side decreases during reciprocation of said second piston.

13. The system according to claim 12 wherein said first and second check valves are of the flapper type.

14. The system according to claim 13 wherein said heating means includes a natural gas fired burner of the porous ceramic type, and wherein the products of combustion are passed through a burner tube means, said refrigerant material being housed outside said burner tube means and absorbing heat therefrom.

15. The system according to claim 14 wherein said pumping means of said power circuit is a positive displacement pump of the diaphragm type.

16. The system according to claim 15 wherein said evaporator means includes means for moving ambient air therethrough, whereby heat transfer from ambient air to said refrigerant material is enhanced.

17. The system according to claim 16 wherein the power circuit further comprises fourth heat exchanger means for exchanging heat between the refrigerant material passing from the first side of the first chamber to the first heat exchanger means, and the refrigerant material passing from the positive displacement pump to the heating means; whereby the refrigerant material passing to the heating means is preheated.

18. The system according to claim 17 wherein said back side of said second chamber is in fluid communication with said accumulator means and is held at an equal pressure therewith, whereby force required to move said second piston to compress said refrigerant is reduced.

19. A system comprising:

a swimming pool housing pool water; and a power circuit including:

hydrocarbon fired heating means for heating and vaporizing a first working fluid;

a first enclosed chamber;

first member means movably mounted in said first chamber for movement responsive to pressure of the first working fluid in said first chamber;

first valve means in fluid communication with the heating means and the first chamber, for selectively delivering the first working fluid to said first chamber and for exhausting the first working fluid from said first chamber;

first heat exchanger means in fluid communication with said first valve means, said first exchanger means receiving first working fluid exhausted from said first chamber, said first heat exchanger means in heat transfer relation with said pool water and delivering heat from said first working fluid thereto said first working fluid being condensed to a liquid therein;

pumping means in fluid communication with said first heat exchanger means and said heating means, for pumping liquid first working fluid from said first heat exchanger means to said heating means; and a spa housing spa water, said power circuit further including third heat exchanger means in heat transfer relation with said spa water, and bypass valve means for directing said first working fluid through said third heat exchanger means in lieu of said first chamber and said first heat exchanger means; and a heat pump circuit including:

compressor means in mechanically powered connection with said first member means of said power circuit for compressing a vaporized second working fluid;

second heat exchanger means in fluid communication with said compressor means and receiving compressed second working fluid therefrom, said second heat exchanger means in heat transfer relation with said pool water for delivering heat from said second working fluid thereto to condense said second working fluid to a liquid;

expansion means in fluid communication with said second heat exchanger means for expanding second working fluid delivered to said expansion means from said second heat exchanger means; and evaporator means in fluid communication with said expansion means and said compressor means, said evaporator means in heat transfer relation with a heat source, said second working fluid receiving heat from said heat source to vaporize said second working fluid in said evaporator means, whereby vaporized second working fluid is delivered from said evaporator means to said compressor means.

20. A system for heating water in at least one of a swimming pool or a spa, comprising:

at least one of swimming pool or spa housing water;

a power circuit including:

hydrocarbon fired heating means for heating and vaporizing a refrigerant material;

a first enclosed chamber;

a first piston means movably mounted in said first chamber for movement responsive to pressure of refrigerant material in said first chamber, said first chamber having a first side and a second side separated by said first piston means;

first valve means in fluid communication with said heating means and said first chamber for selectively delivering refrigerant material to the first side of the first chamber whereby said first piston means moves in a first direction, and for exhausting refrigerant material from said first side whereby said first piston means is enabled to move in an opposed direction;

first heat exchanger means in fluid communication with said first valve means, said first heat exchanger means receiving refrigerant exhausted from said first side of said first chamber, said first heat exchanger means in heat transfer relation with said water and delivering heat from said refrigerant material thereto to condense said refrigerant material to liquid; and pumping means in fluid communication with said first heat exchanger means and said heating means, for pumping liquid refrigerant material from said first heat exchanger means to said heating means; and third heat exchanger means in heat transfer relation with said water, and bypass valve means for directing said refrigerant material through said third heat exchanger means in lieu of said first enclosed chamber and said first heat exchanger means;

a heat pump circuit including:

compressor means in mechanically powered connection with said first member means of said power circuit, for compressing vaporized refrigerant material;

second heat exchanger means in fluid communication with said compressor means and receiving compressed refrigerant material therefrom, said second heat exchanger means in heat transfer relation with said water for delivering heat from said refrigerant material thereto to condense said refrigerant material to liquid;

expansion means in fluid communication with said second heat exchanger means for expanding refrigerant material delivered to said expansion means from said second heat exchanger means; and evaporator means in fluid communication with said expansion means and said compressor means, said evaporator means in heat transfer relation with atmosphere, said refrigerant material receiving heat therefrom to vaporize said refrigerant material, whereby vaporized refrigerant material is delivered from said evaporator means to said compressor means;

and wherein said compressor means of said heat pump circuit comprises:

a second enclosed chamber;

second piston means mounted for movement in said second chamber, said second chamber having a front side and a back side, said sides divided by said second piston means, said second piston means in mechanical connection with said first piston means and reciprocating in response to movement thereof;

and wherein said heat pump circuit further comprises:

second valve means for alternatively admitting refrigerant material from said evaporator to said front side, whereby said second piston means moves said first piston means in the opposed direction when refrigerant material is exhausted from the first side of said first chamber, and for discharging refrigerant material pressurized by movement of said second piston means from said front side to said second heat exchanger means responsive to movement of said first piston means in the first direction.

21. The system according to claim 20 wherein said first piston means of said power unit includes a first rolling diaphragm for maintaining fluid separation between said first and second sides of said first chamber; and wherein said second piston means includes a second rolling diaphragm for maintaining fluid separation between said front and back sides of said second chamber.

22. The system according to claim 21 wherein said first and second piston means are housed in a power unit, said first and second piston means are connected by a rod, and wherein said power unit further comprises:

third piston means in connection with said rod, said third piston means movable with said rod and positioned adjacent said back side of said second chamber;

a third chamber, said third chamber bounded by a third rolling diaphragm in supporting contact with said second piston means, and a fourth rolling diaphragm, said fourth rolling diaphragm in supporting contact with said third piston means; and wherein said third chamber is in fluid communication with said evaporator means.

* * * * *